US009823618B2

(12) United States Patent
Ueno et al.

(10) Patent No.: US 9,823,618 B2
(45) Date of Patent: Nov. 21, 2017

(54) WASTE TONER TRANSPORTING DEVICE AND IMAGE FORMING APPARATUS THEREWITH

(71) Applicant: KYOCERA Document Solutions Inc., Osaka (JP)

(72) Inventors: Masahiro Ueno, Osaka (JP); Hiroaki Ohashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/340,619

(22) Filed: Nov. 1, 2016

(65) Prior Publication Data

US 2017/0146946 A1 May 25, 2017

(30) Foreign Application Priority Data

Nov. 19, 2015 (JP) ..... 2015-226255

(51) Int. Cl.
*G03G 21/00* (2006.01)
*G03G 21/10* (2006.01)
*G03G 21/12* (2006.01)

(52) U.S. Cl.
CPC ..... *G03G 21/105* (2013.01); *G03G 21/10* (2013.01); *G03G 21/12* (2013.01); *G03G 2215/0132* (2013.01)

(58) Field of Classification Search
CPC ..... G03G 21/105; G03G 21/10; G03G 21/12
See application file for complete search history.

(56) References Cited

U.S. PATENT DOCUMENTS

2011/0262174 A1* 10/2011 Gumbe ..... G03G 15/0898 399/92
2013/0108310 A1 5/2013 Hirakawa et al. ..... 399/92
2016/0026119 A1* 1/2016 Ohashi ..... G03G 21/12 399/358
2016/0342131 A1* 11/2016 Kadowaki ..... G03G 21/12
2017/0023878 A1* 1/2017 Uchida ..... G03G 15/0896

FOREIGN PATENT DOCUMENTS

JP 2013-97217 A 5/2013

* cited by examiner

*Primary Examiner* — Ryan Walsh
(74) *Attorney, Agent, or Firm* — Stein IP, LLC

(57) ABSTRACT

A waste toner transporting device includes a waste toner passing passage, a waste toner collection container, a suction passage, a suction device, and a passing passage box. Through the waste toner passing passage, waste toner passes. The waste toner collection container collects the waste toner having passed through the waste toner passing passage. In the suction passage, suspended toner is sucked along with air inside a developing device. The suction device sucks the air inside the suction passage. Inside the passing passage box, the waste toner passing passage constituting part of the waste toner passing passage is formed. The suction passage constituting part of the suction passage is formed inside the passing passage box so as to be connected to the waste toner passing passage.

8 Claims, 6 Drawing Sheets

WASTE TONER TRANSPORTING DEVICE AND IMAGE FORMING APPARATUS THEREWITH

INCORPORATION BY REFERENCE

This application is based upon and claims the benefit of priority from the corresponding Japanese Patent Application No. 2015-226255 filed on Nov. 19, 2015, the entire contents of which are incorporated herein by reference.

BACKGROUND

The present disclosure relates to a waste toner transporting device and to an image forming apparatus incorporating the waste toner transporting device. More particularly, the present disclosure relates to a waste toner transporting device that includes a waste toner passing passage through which waste toner passes and that includes a suction passage for suction of suspended toner inside a developing device, and to an image forming apparatus incorporating such a waste toner transporting device.

In one common process in image forming apparatuses adopting electrophotography, such as copiers, printers, and facsimile machines, powder developer is mainly used, an electrostatic latent image formed on a photosensitive drum (image carrying member) is made visible by use of a developing device, and the visible image (toner image) is transferred to a recording medium directly or via an intermediate transfer member (image carrying member) and is then fixed. Toner left unused on the surface of the image carrying member is removed by a cleaning device and is discharged out of the cleaning device by a discharging mechanism such as a toner discharging screw to be stored in a waste toner collection container.

On the other hand, when toner is fed from the developing device to the photosensitive drum, part of toner may be scattered and leak out through an opening in the developing device opposite the photosensitive drum, contaminating the inside of the image forming apparatus. As a solution, a configuration has been proposed in which a duct is connected to a developing device to collect toner (suspended toner) scattered in the vicinity of an opening in the developing device by use of a suction device.

For example, an image forming apparatus is known in which a dust collection portion is provided to which ducts arranged in upper parts of developing devices are connected via a confluence duct. In the dust collection portion, an exhaust fan is arranged, and between the exhaust fan and the confluence duct, a filter is arranged. The air discharged from the developing devices through air outflow passages into the ducts meets in the confluence duct, and is discharged from the dust collection portion out of the main body of the image forming apparatus.

SUMMARY

According to one aspect of the present disclosure, a waste toner transporting device includes a waste toner passing passage, a waste toner collection container, a suction passage, a suction device, and a passing passage box. Through the waste toner passing passage, waste toner passes which is removed by a cleaning device that removes toner left unused on an image carrying member. The waste toner collection container collects the waste toner having passed through the waste toner passing passage. In the suction passage, suspended toner is sucked along with air inside a developing device that feeds toner to the image carrying member. The suction device sucks the air inside the suction passage. Inside the passing passage box, at least part of the waste toner passing passage is formed. At least part of the suction passage is arranged inside the passing passage box so as to be connected to the waste toner passing passage.

Further features and advantages of the present disclosure will become apparent from the description of embodiments given below.

DETAILED DESCRIPTION

Hereinafter, embodiments of the present disclosure will be described with reference to the accompanying drawings.

Figure 1:
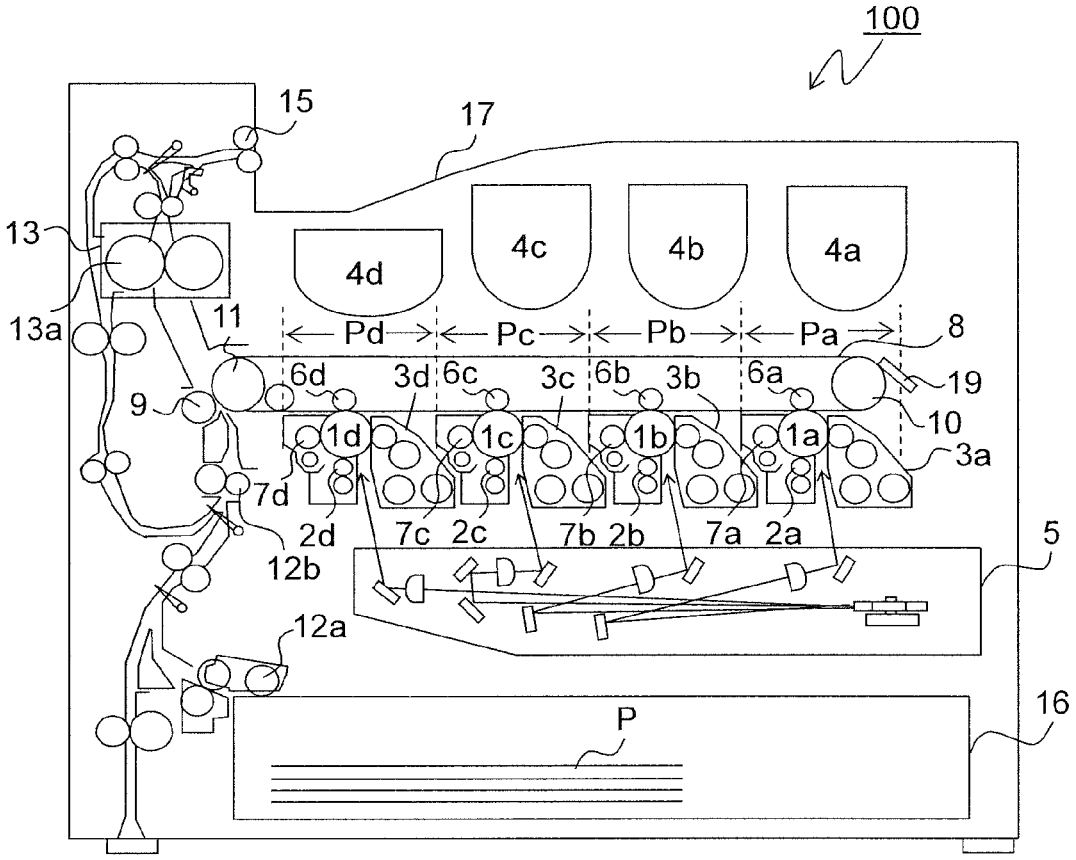
FIG. 1 is a sectional view showing a structure of an image forming apparatus provided with a waste toner transporting device according to one embodiment of the present disclosure.

FIG. 1 is a sectional view schematically showing a structure of an image forming apparatus 100 incorporating a waste toner transporting device according to one embodiment of the present disclosure. In this embodiment, the image forming apparatus 100 is a quadruple-tandem-type color printer that performs image formation by use of four photosensitive drums (image carrying members) 1*a*, 1*b*, 1*c*, and 1*d*, corresponding to four different colors (magenta, cyan, yellow, and black) respectively, which are arranged side by side.

Inside the main body of the image forming apparatus 100, four image forming portions Pa, Pb, Pc and Pd are arranged in this order from the right side in FIG. 1. These image forming portions Pa to Pd are provided to correspond to images of four different colors (magenta, cyan, yellow, and black) respectively, and sequentially form magenta, cyan, yellow, and black images respectively, each through the processes of electrostatic charging, exposure to light, image development, and image transfer.

In these image forming portions Pa to Pd are respectively arranged the photosensitive drums 1*a* to 1*d* that carry visible images (toner images) of the different colors. Moreover, an intermediate transfer belt 8 that rotates in the clockwise direction in FIG. 1 is arranged next to the image forming portions Pa to Pd. Toner images formed on these photosensitive drums 1*a* to 1*d* are sequentially transferred to the intermediate transfer belt (image carrying member) 8 that moves while being in contact with the photosensitive drums 1*a* to 1*d*, and then the toner images are transferred all at once to a sheet P by a secondary transfer roller 9. Then, the toner images are fixed to the sheet P in a fixing device 13, and the sheet P is then discharged out of the main body of the image forming apparatus 100. An image forming process is performed with respect to each of the photosensitive drums 1*a* to 1*d* while these are rotated in the counter-clockwise direction in FIG. 1.

Sheets P to which toner images are to be transferred are stored in a sheet cassette 16 in a lower part of the main body of the image forming apparatus 100, and are transported via a feeding roller 12*a* and a registration roller pair 12*b* to the secondary transfer roller 9. The intermediate transfer belt 8 and the secondary transfer roller 9 are driven to rotate at the same linear velocity as the photosensitive drums 1*a* to 1*d* by a belt driving motor (unillustrated). On the downstream side of the secondary transfer roller 9 (here near a following roller 10), a blade-shaped belt cleaner (cleaning device) 19 is arranged for removing toner and the like remaining on the surface of the intermediate transfer belt 8.

Now, the image forming portions Pa to Pd will be described. Around and under the photosensitive drums 1*a* to 1*d*, which are rotatably arranged, there are arranged charging devices 2*a*, 2*b*, 2*c*, and 2*d* for electrostatically charging the photosensitive drums 1*a* to 1*d*, an exposure unit 5 for exposing the photosensitive drums 1*a* to 1*d* to light based on image data, developing devices 3*a*, 3*b*, 3*c*, and 3*d* for developing, by use of toner, electrostatic latent images formed on the photosensitive drums 1*a* to 1*d*, and drum cleaning devices (cleaning devices) 7*a*, 7*b*, 7*c*, and 7*d* for collecting and removing developer (toner) left unused on the photosensitive drums 1*a* to 1*d* after toner images have been transferred.

When image data is fed in from a host device such as a personal computer, the surfaces of the photosensitive drums 1*a* to 1*d* are first electrostatically charged uniformly by the charging devices 2*a* to 2*d* and are then irradiated with light based on the image data by the exposure unit 5, and thereby electrostatic latent images based on the image data are formed on the photosensitive drums 1*a* to 1*d* respectively. The developing devices 3*a* to 3*d* have developing rollers (developer carrying members) arranged opposite the photosensitive drums 1*a* to 1*d*, and are charged with two-component developer containing toner of different colors, namely magenta, cyan, yellow, and black respectively.

When the proportion of toner contained in the two-component developer stored in the developing devices 3*a* to 3*d* falls below a predetermined value through formation of toner images, which will be described later, toner is supplied from toner containers 4*a* to 4*d* to the developing devices 3*a* to 3*d* respectively. The toner is fed from the developing devices 3*a* to 3*d* onto the photosensitive drums 1*a* to 1*d* respectively, and electrostatically attaches to them, thereby forming toner images based on the electrostatic latent images formed by exposure to light from the exposure unit 5.

Then, a predetermined transfer voltage is applied between primary transfer rollers 6*a* to 6*d* and the photosensitive drums 1*a* to 1*d* by the primary transfer rollers 6*a* to 6*d*, and thereby the magenta, cyan, yellow, and black toner images on the photosensitive drums 1*a* to 1*d* are primarily transferred to the intermediate transfer belt 8. Thereafter, in preparation for subsequent formation of new electrostatic latent images, toner left unused on the surfaces of the photosensitive drums 1*a* to 1*d* is removed by the drum cleaning devices 7*a* to 7*d*.

The intermediate transfer belt 8 is wound around the following roller 10 and a driving roller 11. As the driving roller 11 rotates by being driven by the above-mentioned belt driving motor, the intermediate transfer belt 8 rotates in the clockwise direction; meanwhile, a sheet P is transported from the registration roller pair 12*b*, with predetermined timing, to a nip (secondary transfer nip) between the secondary transfer roller 9, which is arranged next to the intermediate transfer belt 8, and the intermediate transfer belt 8. At the nip, the full-color image is secondarily transferred to the sheet P. The sheet P having the toner images transferred to it is transported to the fixing device 13.

The sheet P transported to the fixing device 13 is heated and pressed while passing through a nip (fixing nip) between a fixing roller pair 13*a*, and thereby the toner images are fixed to the surface of the sheet P to form the predetermined full-color image. The sheet P having the full-color image formed on it is discharged via a discharge roller pair 15 onto a discharge tray 17.

Figure 2:
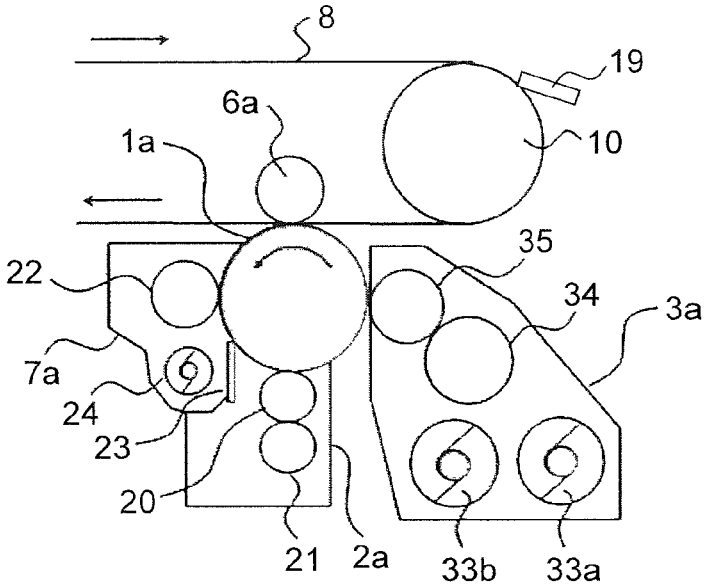
FIG. 2 is a sectional view of and around the image forming portion Pa in FIG. 1.

Now, the above-mentioned image forming portion Pa will be described in detail. The image forming portions Pb to Pd have basically the same structure as the image forming portion Pa, and thus no overlapping description will be repeated. FIG. 2 is a sectional view of and around the image forming apparatus Pa in FIG. 1. Around the photosensitive drum 1*a* are arranged, along the drum rotation direction (the counter-clockwise direction in FIG. 2), the charging device 2*a*, the developing device 3*a*, the primary transfer roller 6*a*, and the drum cleaning device 7*a*, which are mentioned above. Of these components, the primary transfer roller 6*a* is arranged opposite the photosensitive drum 1*a* across the intermediate transfer belt 8.

The charging device 2*a* includes a charging roller 20 for applying a charging bias to the drum surface by making contact with the photosensitive drum 1*a*, and a charging roller cleaning roller 21 for cleaning the charging roller 20.

The drum cleaning device 7*a* includes a rubbing roller (abrasive member) 22, a cleaning blade 23, and a collection spiral 24. The rubbing roller 22 is in pressed contact with the photosensitive drum 1*a* with a predetermined pressure, and is driven to rotate by a drum cleaning motor (unillustrated) in the same direction as the photosensitive drum 1*a* at the plane of contact with it. The linear velocity of the rubbing roller 22 is controlled to be higher than (here 1.2 times) the linear velocity of the photosensitive drum 1*a*.

On the surface of the photosensitive drum 1*a*, on the downstream side of the plane of contact with the rubbing roller 22 with respect to the rotation direction, a cleaning blade 23 is fixed in contact with the photosensitive drum 1*a*.

Waste toner removed from the surface of the photosensitive drum 1*a* by the rubbing roller 22 and the cleaning blade 23 is discharged out of the drum cleaning device 7*a* (see FIG. 2) as the collection spiral 24 rotates.

Figure 3:
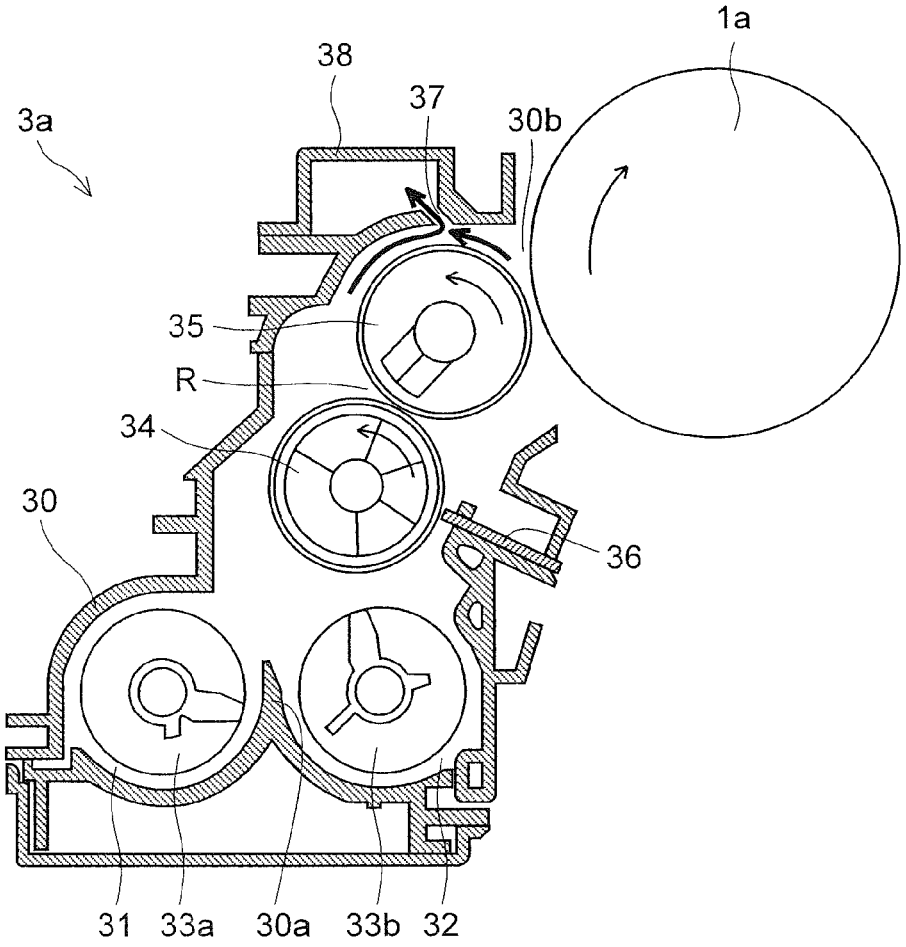
FIG. 3 is a sectional view showing a structure of and around a developing device 3*a;*

FIG. 3 is a sectional view showing a structure of and around the developing device 3*a*. FIG. 3 shows a state as seen from the rear side in FIGS. 1 and 2, and accordingly, in FIG. 3, the arrangement of components inside the developing device 3*a* is reversed left to right as compared with that in FIGS. 1 and 2. In FIG. 3, the thick arrows represent the flow of air. As shown in FIG. 3, the developing device 3*a* has a developer container (casing) 30 for storing two-component developer (hereinafter, referred to simply as developer) containing magnetic carrier and toner, and the developer container 30 is divided into a stir/transport chamber 31 and a feed/transport chamber 32 by a partition wall 30*a*. In the stir/transport chamber 31 and the feed/transport chamber 32, there are rotatably arranged a stirring/transporting screw 33*a* and a feeding/transporting screw 33*b* respectively for mixing and stirring toner fed from the toner container 4*a* (see FIG. 1) with magnetic carrier and for electrostatically charging them.

Then, by the stirring/transporting screw 33*a* and the feeding/transporting screw 33*b*, developer is transported, while being stirred, in the axial direction (the direction perpendicular to the plane of FIG. 3) to circulate between the stir/transport chamber 31 and the feed/transport chamber 32 via unillustrated developer passages formed on opposite end parts of the partition wall 30*a*. That is, the stir/transport chamber 31, the feed/transport chamber 32, and the developer passages constitute a developer circulating passage inside the developer container 30.

The developer container 30 extends obliquely to the upper right side in FIG. 3; inside the developer container 30, a magnetic roller 34 is arranged over the feeding/transporting screw 33*b*, and a developing roller 35 is arranged opposite the magnetic roller 34 obliquely on the upper right of it. A part of the circumferential surface of the developing roller 35 is exposed through an opening 30*b* in the developer container 30, and is arranged opposite the photosensitive drum 1*a*. The magnetic roller 34 and the developing roller 35 rotate in the counter-clockwise direction in FIG. 3.

To the developer container 30, a trimming blade 36 is fitted along the longitudinal direction of the magnetic roller 34 (the direction perpendicular to the plane of FIG. 3). The trimming blade 36 is positioned, with respect to the rotation direction of the magnetic roller 34 (the counter-clockwise direction in FIG. 3), on the upstream side of the opposing region R between the developing roller 35 and the magnetic roller 34. A small gap is formed between a tip end part of the trimming blade 36 and the surface of the magnetic roller 34.

As described above, by the stirring/transporting screw 33*a* and the feeding/transporting screw 33*b*, developer is transported, while being stirred, to circulate through the stir/transport chamber 31 and the feed/transport chamber 32 inside the developer container 30 while toner is electrostatically charged, and by the feeding/transporting screw 33*b*, the developer is transported to the magnetic roller 34. Then, the developer forms a magnetic brush (unillustrated) on the magnetic roller 34. The magnetic brush on the magnetic roller 34 has its layer thickness regulated by the trimming blade 36, and is then transported to the opposing region R between the magnetic roller 34 and the developing roller 35. Then, by the potential difference between a DC voltage applied to the magnetic roller 34 and a DC voltage applied to the developing roller 35 and by the magnetic field produced by the magnetic roller 34, a thin layer of toner is formed on the developing roller 35.

The thin layer of toner formed on the developing roller 35 by the magnetic brush is transported, by the rotation of the developing roller 35, to an opposing region (developing region) between the photosensitive drum 1*a* and the developing roller 35. Since a predetermined bias is applied to the developing roller 35, due to the potential difference between the developing roller 35 and the photosensitive drum 1*a*, toner flies to the photosensitive drum 1*a* from the developing roller 35 so that an electrostatic latent image on the photosensitive drum 1*a* is developed.

In the vicinity of the developing roller 35 (here, in a part on the upstream side of the opposing region R with respect to the rotation direction of the developing roller 35), there is arranged a suction port 37 for suction of air and suspended toner around the opposing region R. The suction port 37 is connected to the suspended toner duct 38.

The suspended toner ducts 38 are formed so as to extend along the longitudinal direction of the developing devices 3*a* to 3*d*, and are formed as parts of the developer containers 30.

In an end part of the stir/transport chamber 31 on the front side of the apparatus (on the rear side with respect to the plane of FIG. 3), a developer discharge passage (unillustrated) is arranged. The developer discharge passage (unillustrated) is provided for discharging surplus developer inside the stir/transport chamber 31 and the feed/transport chamber 32 resulting from supply of fresh developer.

On the front side, with respect to the apparatus, of the developing devices 3*a* to 3*d* and the drum cleaning devices 7*a* to 7*d* (on the front side with respect to the plane of FIG. 1), there is arranged a passing passage box 50 (see FIG. 4) made of resin through which waste toner removed by the drum cleaning devices 7*a* to 7*d* and the belt cleaner 19 passes.

Figure 4:
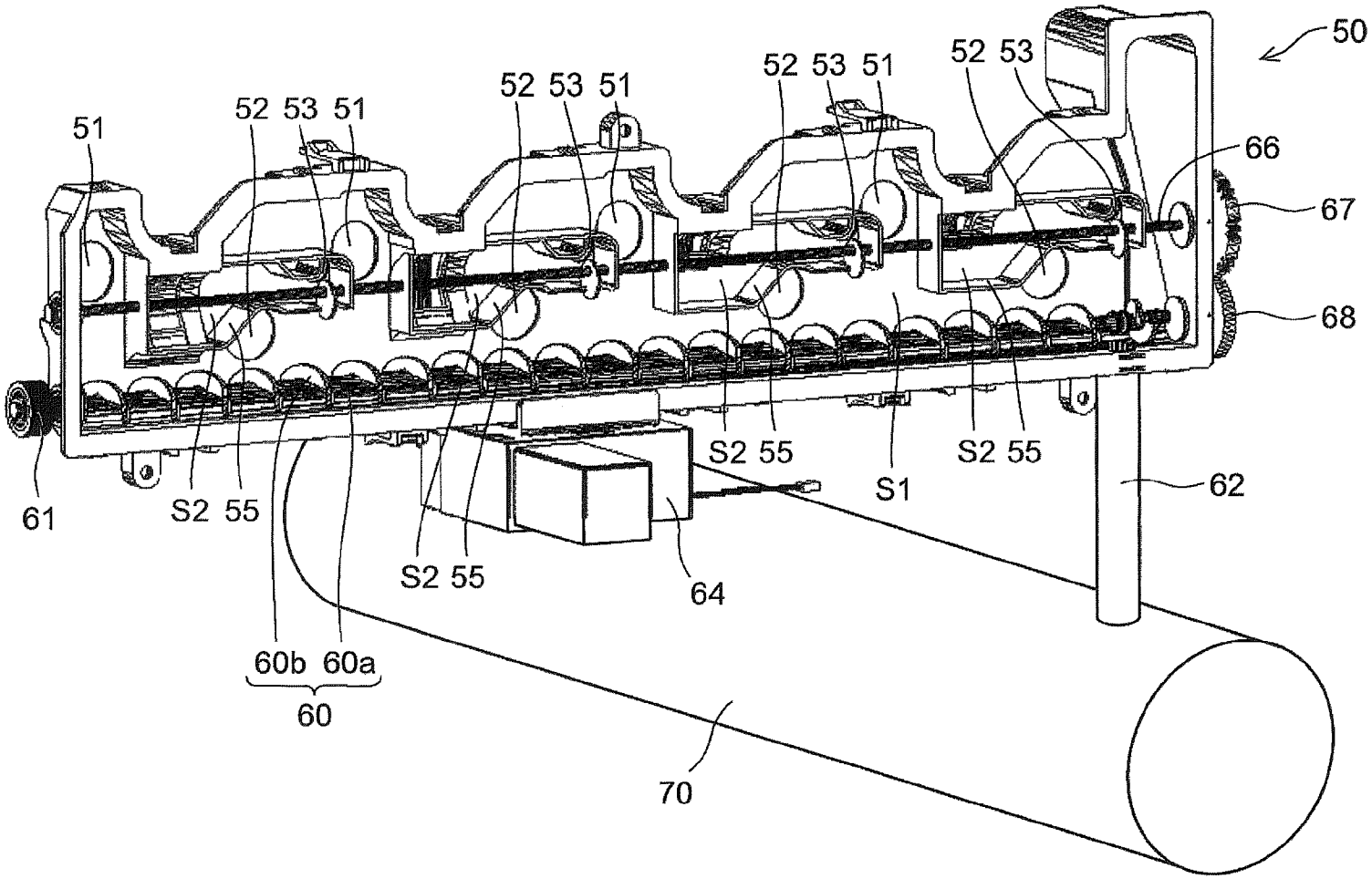
FIG. 4 is a perspective view showing, from in front of the apparatus, a structure of and around a passing passage box of the waste toner transporting device according to one embodiment of the present disclosure.

As shown in FIG. 4, in the passing passage box 50, there are arranged, so as to correspond to the image forming portions Pa to Pd respectively, four waste toner transport-in ports 51 connected to the drum cleaning devices 7*a* to 7*d*, four waste developer transport-in ports 52 connected to the above-mentioned developer discharge passages (unillustrated) of the developing devices 3*a* to 3*d*, and four suspended toner suction ports 53 (see FIGS. 5 and 6) connected to the suspended toner ducts 38 of the developing devices 3*a* to 3*d*. In a left end part, in FIG. 5, of the passing passage box 50, there is arranged a waste toner transport-in port 54 through which waste toner removed from the surface of the intermediate transfer belt 8 by the belt cleaner 19 is transported in. As shown in FIG. 4, inside the passing passage box 50, there are arranged an interior space S1, in which the waste toner transport-in ports 51, the waste developer transport-in ports 52, and the waste toner transport-in port 54 are provided, and interior spaces S2, in which the suspended toner suction ports 53 are provided; the interior space S1 and each of the interior spaces S2 are partitioned from each other by partitions 55. The front side, with respect to the apparatus, of the passing passage box 50 is covered by an unillustrated cover member.

To the waste toner transport-in ports 51, the drum cleaning devices 7*a* to 7*d* are connected; this permits waste toner removed from the surfaces of the photosensitive drums 1*a* to 1*d* to be transported in through the waste toner transport-in ports 51. The waste toner transported in through the waste toner transport-in ports 51 falls to a lower part of the interior space S1.

In the lower part of the interior space S1 in the passing passage box 50, a transporting screw 60 is rotatably arranged for transporting the fallen waste toner to one side (the right side in FIG. 4). The transporting screw 60 has a rotary shaft 60*a* and a helical blade 60*b* provided integrally with the rotary shaft 60*a* and formed in a helical shape with a predetermined pitch in the axial direction of the rotary shaft 60*a*. To the other end part (left end part in FIG. 4) of the rotary shaft 60*a*, a gear 61 is fixed so that a rotation driving force from a driving portion (unillustrated) is input to the rotary shaft 60*a* via the gear 61. On the bottom surface of one end part (right end part in FIG. 4) of the passing passage box 50, a connection pipe 62 is arranged for connecting the passing passage box 50 and a waste toner collection container 70 together. The waste toner collection container 70 is removable from the connection pipe 62.

Thus, the waste toner which has fallen to the lower part of the interior space S1 in the passing passage box 50 is transported to one side (the right side in FIG. 4) by the transporting screw 60, passes through the connection pipe 62, and is stored inside the waste toner collection container 70.

The drum cleaning devices 7*a* to 7*d*, the interior space S1, and the connection pipe 62 constitute a waste toner passing passage through which waste toner from the drum cleaning devices 7*a* to 7*d* passes.

To the waste developer transport-in ports 52, the developer discharge passages (unillustrated) of the developing devices 3*a* to 3*d* are connected; this permits surplus developer inside the stir/transport chambers 31 and the feed/transport chambers 32 to be transported in through the waste developer transport-in ports 52. The waste developer transported in through the waste developer transport-in ports 52 falls to the lower part of the interior space S1 in the passing passage box 50, is transported to one side (the right side in FIG. 4) by the transporting screw 60, passes through the connection pipe 62, and is stored inside the waste toner collection container 70.

The developer discharge passages (unillustrated) of the developing devices 3*a* to 3*d*, the interior space S1, and the connection pipe 62 constitute a waste toner passing passage through which waste toner (waste developer) from the developing devices 3*a* to 3*d* passes.

To the waste toner transport-in port 54, a waste toner discharge passage (unillustrated) is connected for connecting the belt cleaner 19 and the passing passage box 50 together; this permits waste toner removed from the surface of the intermediate transfer belt 8 to be transported in through the waste toner transport-in port 54. The waste toner transported in through the waste toner transport-in port 54 falls to the lower part of the interior space S1 in the passing passage box 50, passes through the connection pipe 62, and is stored inside the waste toner collection container 70.

The waste toner discharge passage (unillustrated), the interior space S1, and the connection pipe 62 constitute a waste toner passing passage through which waste toner from the intermediate transfer belt 8 passes.

To the suspended toner suction ports 53, suspended toner ducts 38 of the developing devices 3*a* to 3*d* are connected; this permits suspended toner inside the developing devices 3*a* to 3*d* to be sucked along with air through the suspended toner suction ports 53.

Figure 6:
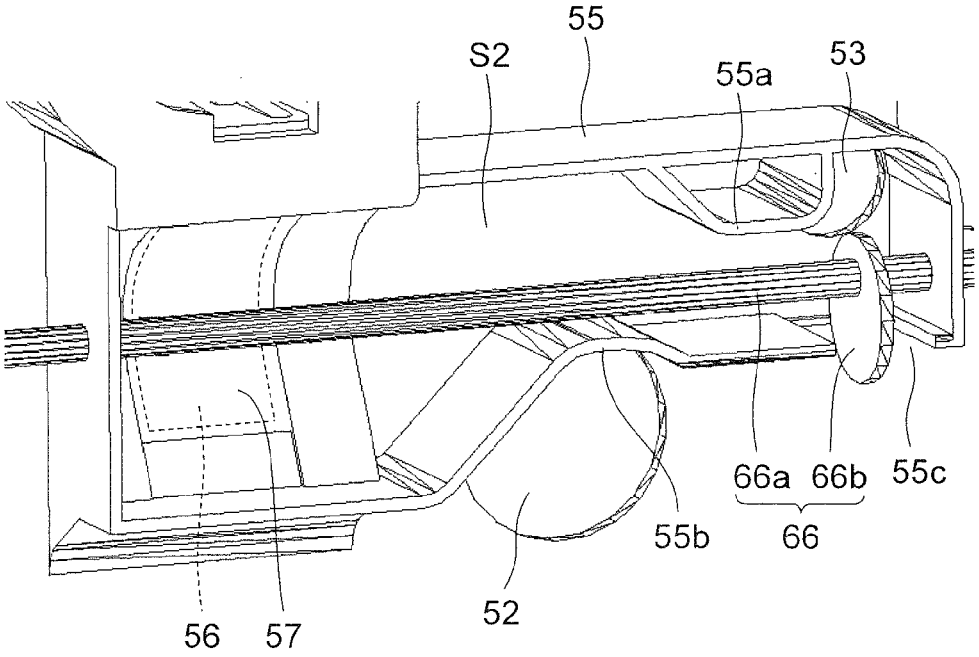
FIG. 6 is a perspective view showing a structure of and around a suspended toner suction port in the passing passage box of the waste toner transporting device according to one embodiment of the present disclosure.

As shown in FIG. 6, the suspended toner suction port 53 is connected to the interior space S2, and is surrounded from around by the partition 55. The interior space S2 is so formed as to extend in the left/right direction in FIG. 6. In one end part (the right end part in FIG. 6) in the interior space S2, the suspended toner suction port 53 is formed; in the other end part (the left end part in FIG. 6) in the interior space S2, a discharge port 56 is formed for discharging air.

Figure 5:
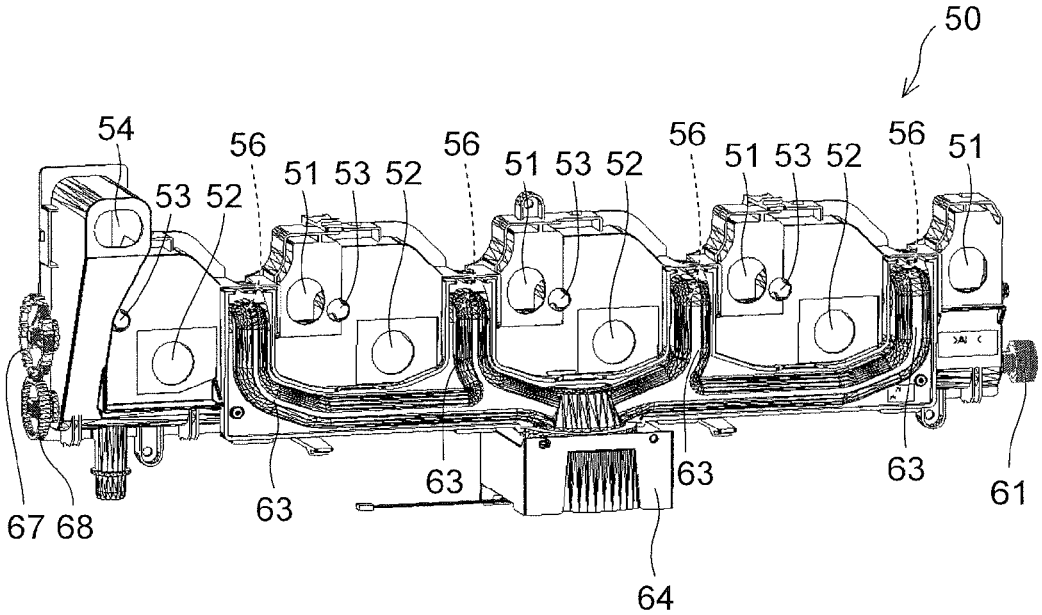
FIG. 5 is a perspective view showing, from behind of the apparatus, a structure of and around the passing passage box of the waste toner transporting device according to one embodiment of the present disclosure.

To the discharge port 56, a filter 57 is fitted for catching toner. As shown in FIG. 5, to the discharge ports 56, discharge passages 63 are connected. The discharge passages 63 join together at the downstream end thereof, and are connected to a discharge fan (suction device) 64. When the discharge fan 64 is driven, a negative pressure is produced in the discharge passages 63, and thus the suspended toner inside the developing devices 3*a* to 3*d* is directed along with air to the interior spaces S2 in the passing passage box 50. The air having passed through the filters 57 and the discharge passages 63 is discharged out of the main body of the image forming apparatus 100 via an unillustrated discharge passage by the discharge fan 64.

The suspended toner ducts 38 of the developing devices 3*a* to 3*d*, the interior spaces S2, and the discharge passages 63 constitute a suction passage for suction of suspended toner along with air inside the developing devices 3*a* to 3*d*.

As shown in FIG. 6, on the partition 55 that forms the interior space S2, in a part on the downstream side (left side in FIG. 6) of a door 65*a* (see FIG. 7), which will be described later, with respect to the suction direction, there are arranged an upper protruding portion 55*a* protruding downward from an upper part in the interior space S2, and a lower protruding portion 55*b* protruding upward from a lower part in the interior space S2. This helps restrain suspended toner from being transported to the downstream side with respect to the suction direction. In the partition 55, an opening 55*c* is formed under the suspended toner suction port 53.

Figure 7:
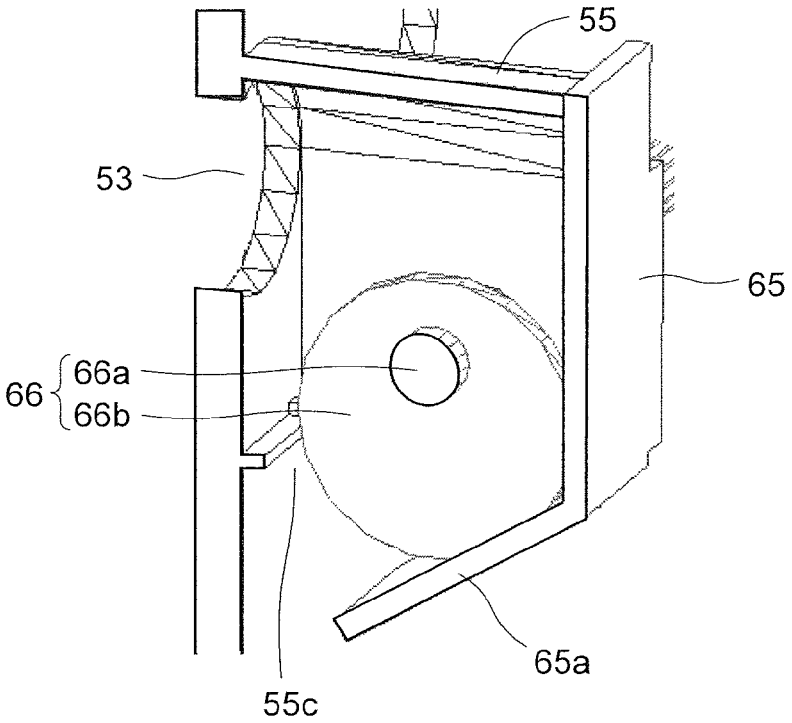
FIG. 7 is a sectional perspective view showing a structure of and around the suspended toner suction port in the passing passage box of the waste toner transporting device according to one embodiment of the present disclosure.

The partition 55 is provided with a cover member 65 (see FIG. 7) made of resin so as to cover the front side, in FIG. 6, of the interior space S2. As shown in FIG. 7, in a lower part of the cover member 65, the door 65*a* is formed that can open and close the opening 55*c*.

Figure 8:
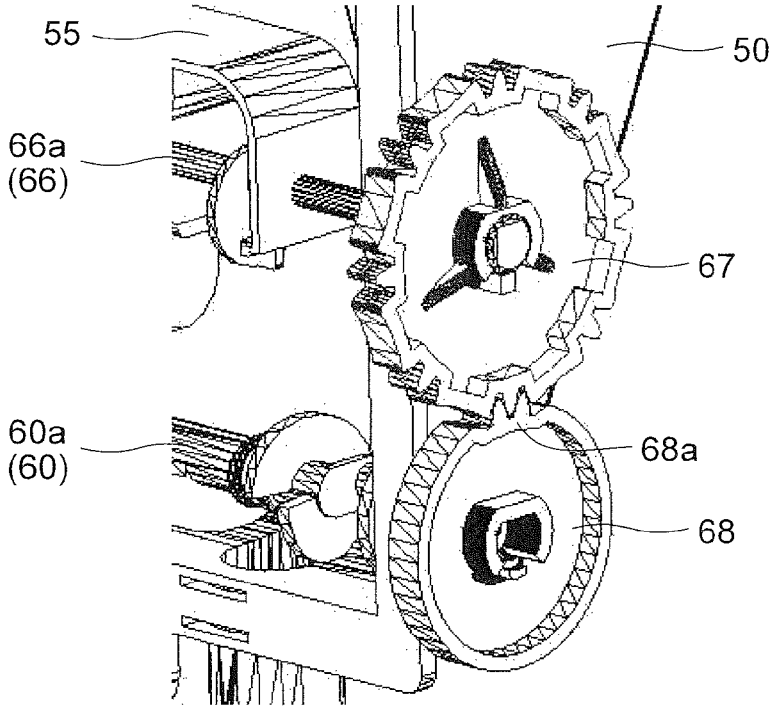
FIG. 8 is a perspective view showing a structure of and around one end part of an opening/closing mechanism of the waste toner transporting device according to one embodiment of the present disclosure.

The passing passage box 50 is provided with an opening/closing mechanism 66 for opening and closing the doors 65*a*. The opening/closing mechanism 66 has a shaft 66*a* which is rotatably supported on the passing passage box 50, and rotary members 66*b* which protrude from the shaft 66*a* in the radial direction and which rotate together with the shaft 66*a*. To one end part (the right end part in FIG. 4) of the shaft 66*a*, a gear 67 is fixed. The gear 67 meshes with a gear 68 which is fixed to one end part of the rotary shaft 60*a* of the transporting screw 60, and thus the opening/closing mechanism 66 rotates in a manner coordinated with the rotation of the transporting screw 60. As shown in FIG. 8, the gear 68 has a toothed portion 68*a* in only one part of its circumferential surface, and thus the opening/closing mechanism 66 rotates one turn as the transporting screw 60 rotates several turns (here, eight turns).

As shown in FIG. 7, the rotary member 66*b* is arranged over the entire circumference of the shaft 66*a* in the circumferential direction, and is an eccentric cam such that the distance from the center of the shaft 66*a* to the circumferential surface of the rotary member 66*b* varies. Thus, the rotary member 66*b* rotates in a manner coordinated with the rotation of the transporting screw 60, and, as shown in FIG. 7, the rotary member 66*b* making contact with the door 65*a* causes the door 65*a* to open. On the other hand, the rotary member 66*b* rotating farther and moving away from the door 65*a* causes the door 65*a* to close with the restoring force of the cover member 65.

In the interior space S2, due to its large air passing sectional area as compared with that of the suspended toner suction port 53, the speed of suction reduces. Thus, suspended toner tends to fall and deposit below the suspended toner suction port 53. In particular, the suspended toner tends to fall to and deposit in a part of the interior space S2 where suspended toner enters it through the suspended toner suction port 53, because there the traveling direction of suspended toner changes 90 degrees.

Then, the suspended toner which has fallen below the suspended toner suction port 53 moves (falls) to the interior space S1 via the door 65*a*, which is opened on a regular basis, is transported to one side (the right side in FIG. 4) by the transporting screw 60, passes through the connection pipe 62, and is stored inside the waste toner collection container 70.

The suspended toner ducts 38 of the developing devices 3*a* to 3*d*, the interior spaces S2, the interior space S1, and the connection pipe 62 constitute an suspended toner passing passage through which suspended toner inside the developing devices 3*a* to 3*d* passes.

In this embodiment, as described above, the interior spaces S2 that constitute a suction passage are arranged inside the passing passage box 50 so as to be connected to the interior space S1 that constitutes a waste toner passing passage. This permits suspended toner to be moved from the suction passage via the waste toner passing passage to the waste toner collection container 70. That is, there is no need to provide a suspended toner collection container for collecting suspended toner in addition to the waste toner collection container 70. Thus, as compared with a case where both the suspended toner collection container and the waste toner collection container 70 are provided separately, it is possible to suppress complicating replacement work for a collection container, and thus to improve serviceability.

Thus, a space for arranging an additional collection container can be eliminated; this helps suppress an increase in the size of the image forming apparatus 100.

In a case where a detecting sensor is provided for detecting a collection container being full, it is possible to eliminate one detecting sensor, and thus to simplify the configuration and suppress the cost.

As described above, the opening 55*c* in the partition 55 is provided with the door 65*a*, which is openable and closable. Thus, opening the door 65*a* allows suspended toner inside the interior space S2 to be moved to the interior space S1. On the other hand, closing the door 65*a* makes it possible to suppress a lowering in the suction force with respect to suspended toner inside the developing devices 3*a* to 3*d*.

As described above, as a result of the rotary member 66*b* rotating in a manner coordinated with the rotation of the transporting screw 60, the rotary member 66*b* makes contact with and moves away from the door 65*a* to cause the door 65*a* to open and close respectively. With this configuration, in a manner coordinated with the rotation of the transporting screw 60, suspended toner inside the interior space S2 can be moved to the interior space S1 on a regular basis, and thus it is possible to restrain toner from clogging in the interior space S2.

As described above, the rotary member 66*b* is an eccentric cam such that the distance from the center of the shaft 66*a* to the circumferential surface of the rotary member 66*b* varies. Thus, the door 65*a* can be opened and closed easily on a regular basis.

As described above, the door 65*a* is arranged below the suspended toner suction port 53. Suspended toner tends to fall to and deposit in a part of the passing passage box 50 where suspended toner enters it through the suspended toner suction port 53, because the traveling direction of suspended toner changes 90 degrees. Thus, as a result of the door 65*a* being arranged below the suspended toner suction port 53, it is possible to efficiently move suspended toner inside the interior space S2 to the interior space S1.

As described above, in the interior space S2 are arranged, in a part to the downstream side of the door 65*a*, with respect to the suction direction, the upper protruding portion 55*a* protruding downward from an upper part in the interior space S2, and the lower protruding portion 55*b* protruding upward from a lower part in the interior space S2. This helps restrain suspended toner from moving to the downstream side with respect to the suction direction, and thus permits more suspended toner to fall and move to the interior space S1. It is also possible to reduce the amount of suspended toner that reaches the filter 57.

It should be understood that the embodiments disclosed herein are in every aspect illustrative and not restrictive. The scope of the present disclosure is defined not by the description of embodiments given above but by the appended claims, and encompasses many modifications and variations made in the sense and scope equivalent to those of the claims.

For example, although the above-described embodiment deals with an example where the present disclosure is applied to a color printer, this is not meant as any limitation. Needless to say, the present disclosure is applicable to various image forming apparatuses provided with a waste toner passing passage through which waste toner passes and a suction passage for suction of suspended toner inside a developing device, examples including monochrome printers, monochrome copiers, color copiers, digital multifunction peripherals, facsimile machines, etc.

Figure 9:
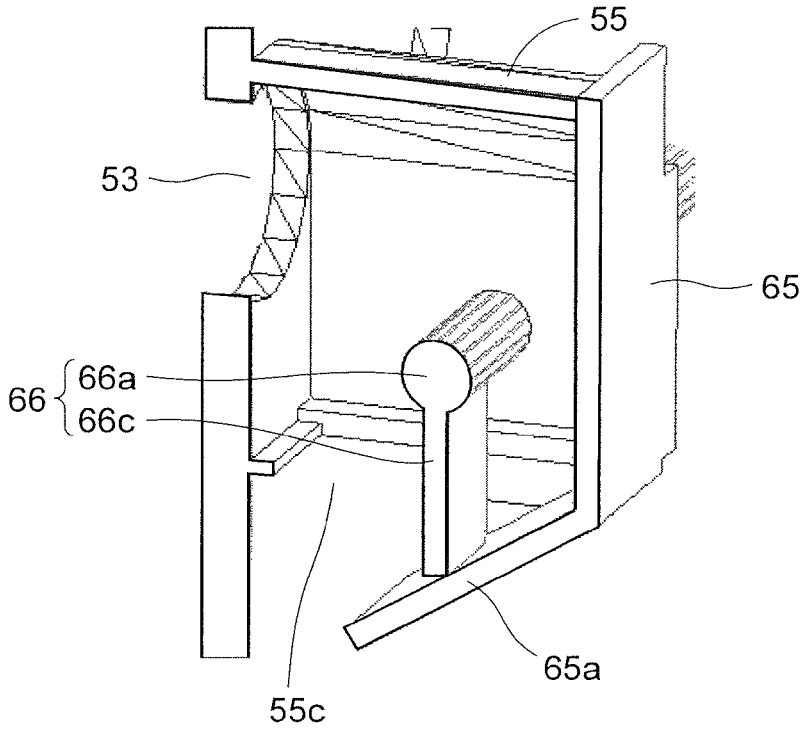
FIG. 9 is a sectional perspective view showing a structure of and around an suspended toner suction port in a passing passage box of a waste toner transporting device according to a modified example of the present disclosure, with a door open as a result of a rotary member pressing the door.
Figure 10:
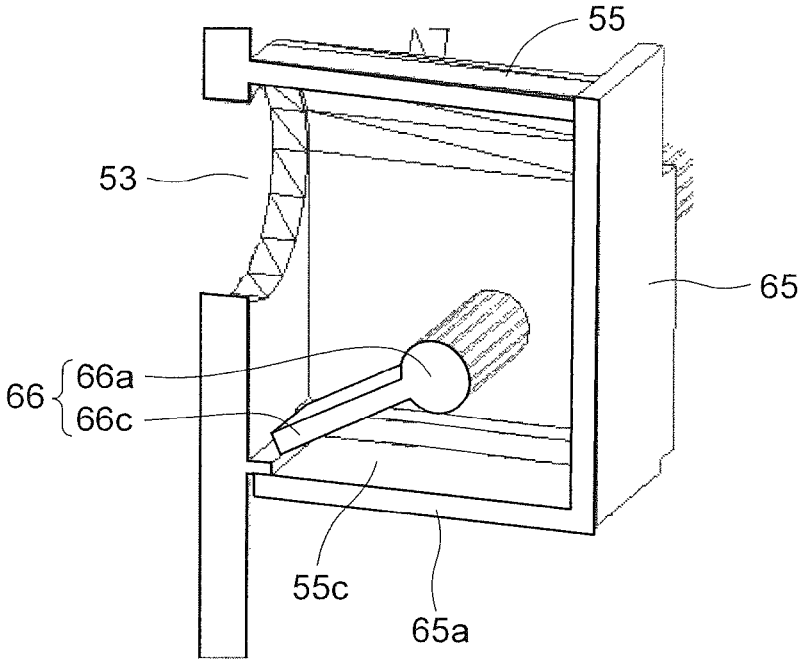
FIG. 10 is a sectional perspective view showing a structure of and around the suspended toner suction port in the passing passage box of the waste toner transporting device according to the modified example of the present disclosure, with the door closed as a result of the rotary member moving away from the door.

Although the above-described embodiment deals with an example where the rotary member 66*b* is an eccentric cam, this is in no way meant to limit the present disclosure. For example, as in the image forming apparatus according to a modified example of the present disclosure shown in FIGS. 9 and 10, the rotary member 66*c* may be a paddle protruding in a predetermined direction (radially outward) from a part of the shaft 66*a* in the circumferential direction and extending along the shaft 66*a*. In this case, as in the above-described embodiment, as a result of the rotary member 66*c* rotating, as shown in FIG. 9, the rotary member 66*c* makes contact with the door 65*a* to cause the door 65*a* to open. On the other hand, the rotary member 66*c* rotates farther and, as shown in FIG. 10, the rotary member 66*c* moves away from the door 65*a* to cause the door 65*a* to close with the restoring force of the cover member 65. Thus, with a rotary member 66*c* formed as a paddle as described above, as compared with a case where an eccentric cam is used, it is possible to reduce the opening duration of the door 65*a*, and thereby to reduce the duration in which the suction force lowers with respect to suspended toner inside the developing devices 3*a* to 3*d*.

What is claimed is:

1. A waste toner transporting device comprising:

a waste toner passing passage through which waste toner passes which is removed by a cleaning device that removes toner left unused on an image carrying member;

a waste toner collection container for collecting the waste toner having passed through the waste toner passing passage;

a suction passage for suction of suspended toner along with air inside a developing device that feeds toner to the image carrying member;

a suction device for sucking the air inside the suction passage; and a passing passage box inside which at least part of the waste toner passing passage is formed, wherein at least part of the suction passage is arranged inside the passing passage box so as to be connected to the waste toner passing passage.

2. The waste toner transporting device of claim 1, wherein inside the passing passage box, a partition is arranged for partitioning between the waste toner passing passage and the suction passage, the partition is provided with a door which is openable and closable, and the passing passage box is provided with an opening/closing mechanism for opening and closing the door.

3. The waste toner transporting device of claim 2, wherein in the waste toner passing passage in the passing passage box, a transporting screw is arranged for transporting waste toner, the opening/closing mechanism has a shaft which is rotatably supported on the passing passage box, and has a rotary member which protrudes from the shaft in a radial direction and which rotates together with the shaft, and as a result of the rotary member rotating in a manner coordinated with rotation of the transporting screw, the rotary member makes contact with and moves away from the door to cause the door to open and close respectively.

4. The waste toner transporting device of claim 3, wherein the rotary member is arranged over an entire circumference of the shaft in a circumferential direction thereof, and is an eccentric cam such that a distance from a center of the shaft to a circumferential surface of the rotary member varies.

5. The waste toner transporting device of claim 3, wherein the rotary member is a paddle protruding in a predetermined direction from a part of the shaft in a circumferential direction thereof and extending along the shaft.

6. The waste toner transporting device of claim 2, wherein in the passing passage box, a suspended toner suction port is formed which is connected to the developing device and through which the air and suspended toner in the developing device are sucked, and the door is arranged below the suspended toner suction port.

7. The waste toner transporting device of claim 2, wherein in the suction passage inside the passing passage box, in a part to a downstream side of the door with respect to a suction direction, an upper protruding portion is arranged that protrudes downward from an upper part of the suction passage, and a lower protruding portion is arranged that protrudes upward from a lower part of the suction passage.

8. An image forming apparatus comprising the waste toner transporting device of claim 1.

* * * * *